US011044969B2

(12) United States Patent
Stassinopoulos

(10) Patent No.: US 11,044,969 B2
(45) Date of Patent: Jun. 29, 2021

(54) BUTTON-SUPPORTED FASHION ACCESSORY

(71) Applicant: Jacquelyn Stassinopoulos, Novi, MI (US)

(72) Inventor: Jacquelyn Stassinopoulos, Novi, MI (US)

( * ) Notice: Subject to any disclaimer, the term of this patent is extended or adjusted under 35 U.S.C. 154(b) by 0 days.

(21) Appl. No.: 16/599,302

(22) Filed: Oct. 11, 2019

(65) Prior Publication Data

US 2020/0113293 A1 Apr. 16, 2020

Related U.S. Application Data

(60) Provisional application No. 62/744,783, filed on Oct. 12, 2018.

(51) Int. Cl.

| | |
|---|---|
| ***A44B 5/00*** | (2006.01) |
| ***A44B 1/14*** | (2006.01) |
| ***A44B 1/04*** | (2006.01) |

(52) U.S. Cl.
CPC . *A44B 1/14* (2013.01); *A44B 1/04* (2013.01)

(58) Field of Classification Search
CPC ..... A44B 1/14; A44B 1/04
See application file for complete search history.

(56) References Cited

U.S. PATENT DOCUMENTS

| | | | | |
|---|---|---|---|---|
| 479,914 A | | 8/1892 | Morris | |
| 1,235,575 A | | 8/1917 | Kliesrath et al. | |
| 1,520,395 A | * | 12/1924 | Becker | A44C 11/00 24/3.13 |
| 1,678,265 A | | 7/1928 | Myers et al. | |
| 1,774,033 A | * | 8/1930 | Harrison | A43C 11/08 24/113 MP |
| 1,807,224 A | * | 5/1931 | Mieres | A41F 11/16 24/520 |
| 2,070,016 A | * | 2/1937 | Lipton | A41F 11/04 2/300 |
| 2,776,434 A | * | 1/1957 | Ellestad | A44B 1/14 2/123 |
| 2,850,779 A | * | 9/1958 | Dobro | A44B 1/14 40/315 |
| 2,880,487 A | * | 4/1959 | Ryan | A44B 1/14 24/113 MP |
| 2,994,980 A | * | 8/1961 | Theriot | A44B 1/14 40/315 |

(Continued)

*Primary Examiner* — Jason W San
(74) *Attorney, Agent, or Firm* — Endurance Law Group PLC

(57) ABSTRACT

A decorative button cover assembly for trousers and other types of clothing to be worn as a fashion accessory. The assembly includes an elongated slider bar that establishes a constrained path configured to guide a button captive back-and-forth. A snare is attached to one end of the slider bar and a bracket to the other end, and has an aperture configured to receive and then trap the head of the button. The aperture is bounded on one side by an interior stopper edge. The bracket has a standoff portion and a mounting portion. A decorative cover is supported from the mounting portion of the bracket and spaced from the slider bar. In use, the assembly is inextricably trapped between under- and over-flap sections of the trousers, and yet the decorative cover is moveable toward and away from a position directly overlying the button head.

20 Claims, 7 Drawing Sheets

(56) References Cited

U.S. PATENT DOCUMENTS

| | | | | | |
|---|---|---|---|---|---|
| RE25,178 | E | | 5/1962 | Theriot | |
| 3,353,231 | A | * | 11/1967 | Levine | A44B 1/14 24/113 R |
| 3,934,313 | A | * | 1/1976 | Hocq | A44B 5/007 24/113 MP |
| 5,337,584 | A | * | 8/1994 | Angeli | A44B 1/14 24/113 R |
| 7,389,567 | B2 | * | 6/2008 | Rogers | A42B 1/24 24/113 R |
| 8,726,469 | B1 | * | 5/2014 | Delaneau | A44B 1/04 24/113 R |
| 9,198,480 | B1 | * | 12/2015 | Junge | A44B 1/14 |
| 9,307,806 | B1 | * | 4/2016 | Dorman | A44B 17/0005 |
| 9,993,047 | B1 | * | 6/2018 | Patterson | A44B 1/14 |
| 2010/0083703 | A1 | | 4/2010 | Delaneau | |

* cited by examiner

BUTTON-SUPPORTED FASHION ACCESSORY

CROSS REFERENCE TO RELATED APPLICATIONS

This application claims priority to Provisional Patent Application U.S. 62/744,783 filed on Oct. 12, 2018, the entire disclosure of which is hereby incorporated by reference and relied upon.

BACKGROUND OF THE INVENTION

Field of the Invention

The invention relates generally to ornamental button covers, and more particularly to ornamental covers that slidably attach to buttons of the type found on trousers and other types of clothing articles.

Description of Related Art

A fashion accessory is any item that accentuates a wearer's outfit. Some fashion accessories are carried by the wearer, whereas others are worn. Fashion accessories have become standard in the garment industry.

Accessories can be worn in many ways ranging from hair to wristbands. Brooches and other forms of jewelry fastened to clothing with a pin are popular fashion accessories. Stylish belt buckles are often equated with a brooch, in terms of jewelry fastened to clothing but through the use of a belt providing the method of attachment to the wearer. While many people desire to accessorize with belt buckles, belts to carry the buckle are not always desirable. For instance, when wearing certain types or styles of shorts, pants and other dress type garments, a belt may not be feasible. In these situations, the wearer is unable to take advantage of the belt buckle as a form of fashion accessories.

There have been some attempts to accessorize the buttons of shirt sleeve cuffs, such as shown for example in U.S. Pat. No. 3,934,313 to Hocq, issued Jan. 27, 1976. Hocq has but limited application due to several inherent design deficiencies which include a hinged cover that introduces manufacturing complexity and cost, as well as a wire-clip that is only conducive to shirt-sleeve applications. U.S. Pat. No. 8,726,469 to Delaneau and U.S. Pat. No. 9,993,047 to Patterson both describe button covers specifically designed for trouser applications. U.S. Pat. No. 1,774,033 to Myers and U.S. Pat. No. 9,198,480 to Junge both depict examples of covers where the clip is curved to better conform to the shape of the wearer's body.

One particularly deficient aspect to all of the prior art examples is that they are designed to be attached to, and detached from, the article of clothing while the flap is secured in a closed condition. While perhaps convenient for purposes of installation and removal, the button cover can be accidentally dislodged and lost, such as when the wearer brushes unawares against something. All of these prior art examples of button covers can be accidentally un-clipped in use and perhaps lost.

There is therefore a need in the art for an improved fashion accessory that is readily adaptable to various uses, including but not limited to belt-buckle type applications, which provides a more secure connection, which is comfortable to wear, which is easily installed and removed, which is durable and inexpensive to manufacture.

SUMMARY OF THE INVENTION

According to a first aspect of the invention, a removeable decorative button cover assembly comprises an elongated slider bar. The slider bar has a service end and a display end. The slider bar establishes a constrained path between the service and display ends configured to guide a captive button back-and-forth therealong. A bracket extends from the display end of the slider bar. The bracket has a standoff portion and a mounting portion. The standoff portion is directly connected to the slider bar. The mounting portion is connected to the standoff portion and is spaced from the slider bar generally over the display end. A decorative cover is supported from the mounting portion of the bracket and is also spaced from the slider bar generally over the display end. A snare is attached to the service end of the slider bar. The snare has an aperture configured to receive and then trap the head of the button on one side of the slider bar. The aperture is bounded on one side thereof by an interior stopper edge.

According to a second aspect of the invention, a combination is composed of an article of clothing and removeable decorative button cover assembly therefor. The article of clothing has a flap section. The flap section comprises an under-flap portion and an opposing over-flap portion. A button is secured to the under-flap section. The button has an enlarged head attached to and extending from a shaft. The shaft has a shaft diameter. The head of the button has a head diameter that is greater than the shaft diameter. The over-flap includes a slot, and the slot has a length greater than the head diameter of the button. The flap section is configured to be secured in a closed condition by inserting the head of the button through the slot on the over-flap. An elongated slider bar has a service end and a display end. The slider bar has opposing interior boundary edges establishing a constrained path between the service and display ends configured to guide the button captive back-and-forth therealong. A bracket extends from the display end of the slider bar. The bracket has a standoff portion and a mounting portion. The standoff portion is directly connected to the slider bar. The mounting portion connected to the standoff portion and is spaced from the slider bar generally over the display end. A decorative cover is supported from the mounting portion of the bracket and also spaced from the slider bar generally over the display end. A snare is attached to the service end of the slider bar. The snare has an aperture configured to receive and then trap the head of the button on one side of the slider bar. The aperture is bounded on one side thereof by an interior stopper edge. In combination, the slider bar is inextricably trapped between the under-flap and over-flap sections on the shaft of the button when the button head is secured through the slot on the over-flap. In the inextricably trapped condition, the decorative cover is moveable toward and away from a position directly overlying the button head.

The claimed invention has many advantages. For example, the slider bar of this invention can be inextricably trapped between the under-flap and over-flap sections of an article of clothing, on the shaft of the button, when the button head is secured through a slot in the over-flap. That is to say, when the flap is secured closed, the decorative cover assembly cannot be removed from the article of clothing. Despite being inextricably trapped, the decorative cover 40 is nevertheless freely moveable toward and away from a position directly overlying the button head. Travel of the captive button is arrested at one end by the bounded interior stopper edge of the snare, and at the other end by the bracket colliding with the over-flap. If the user accidentally snags the decorative cover, the entire assembly cannot be disconnected from the article of clothing. The configuration of the snare permits the assembly to be discretely installed with only minimal expose of the over-flap. A still further advantage is that the snare is prone to retain the assembly on the button even after the flap has been undone. When the flap becomes unsecured for whatever reason, the snare with its interior stopper edge will naturally cling to the button, thus reducing the likelihood of the assembly falling to the floor. These are but a few of the many advantages of the present invention.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Referring to the figures, wherein like numerals indicate like or corresponding parts throughout the several views, a removeable decorative button cover assembly is generally shown at 10. The assembly 10 is designed and intended to cover the button of an article of clothing. Throughout the illustrated examples, the article of clothing is depicted in the exemplary form of trouser pants, generally indicated at 12. However, it should be understood that the article of clothing could instead be a shirt, blouse, jacket or the like. Furthermore, the article of clothing need not necessary be clothing. For example, the article of clothing could be a hand-carried or body-worn utility article such as purse, satchel, bag or the like. Regardless of the type of garment or item, the article of clothing will have an encircling feature, such as a waistband in the case of trousers 12 or a cuff in the case of a shirt sleeve or an opening in the case of a purse, etc., that is made discontinuous by means of a flap. The flap can be selectively unsecured in order to facilitate dressing and un-dressing in the case of garments, or otherwise easily passing objects through the encircling feature.

Figure 6A:
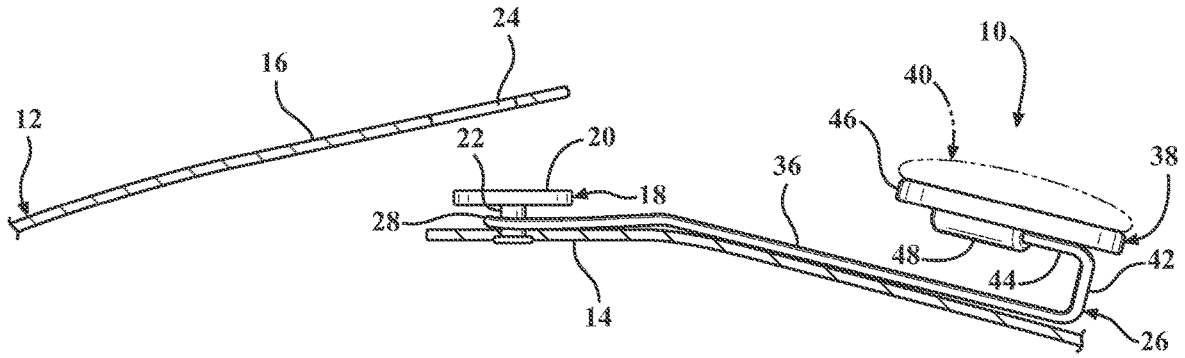
FIG. 6A is a simplified view from the perspective of a user, corresponding generally to FIG. 1A, showing the flap section of trouser pants with the over-flap section temporarily unsecured to expose the head of a button, and a removeable decorative button cover assembly according to one embodiment of the invention disposed for installation.

Regardless of the type of garment, the flap can be defined in most cases by an under-flap 14 and an opposing over-flap 16. A button 18 is securely attached to the under-flap 14. The button 18 has an enlarged head 20 attached to and extending from a shaft 22. The shaft 22 may either be flexible, as in the case of sewing thread or the like, or rigid. When of the rigid type, the shaft 22 is generally cylindrical and can be defined as having a shaft diameter. A flexible shaft 22 will also have a transverse dimension that can be easily correlated to the diameter of a rigid shaft 22. The head 20 of the button 18 can be any geometric shape, but in many cases is generally circular. When in the circular form, the head 20 may be defined as having a head diameter that is greater than the shaft diameter. A non-circular head 20 will also have a transverse dimension that can be easily correlated to the diameter of a circular head 20. This differential in the relative diameters or dimensions between head 20 and shaft 22 are best seen in FIGS. 6A-7, and is common in the art.

Figure 1B:
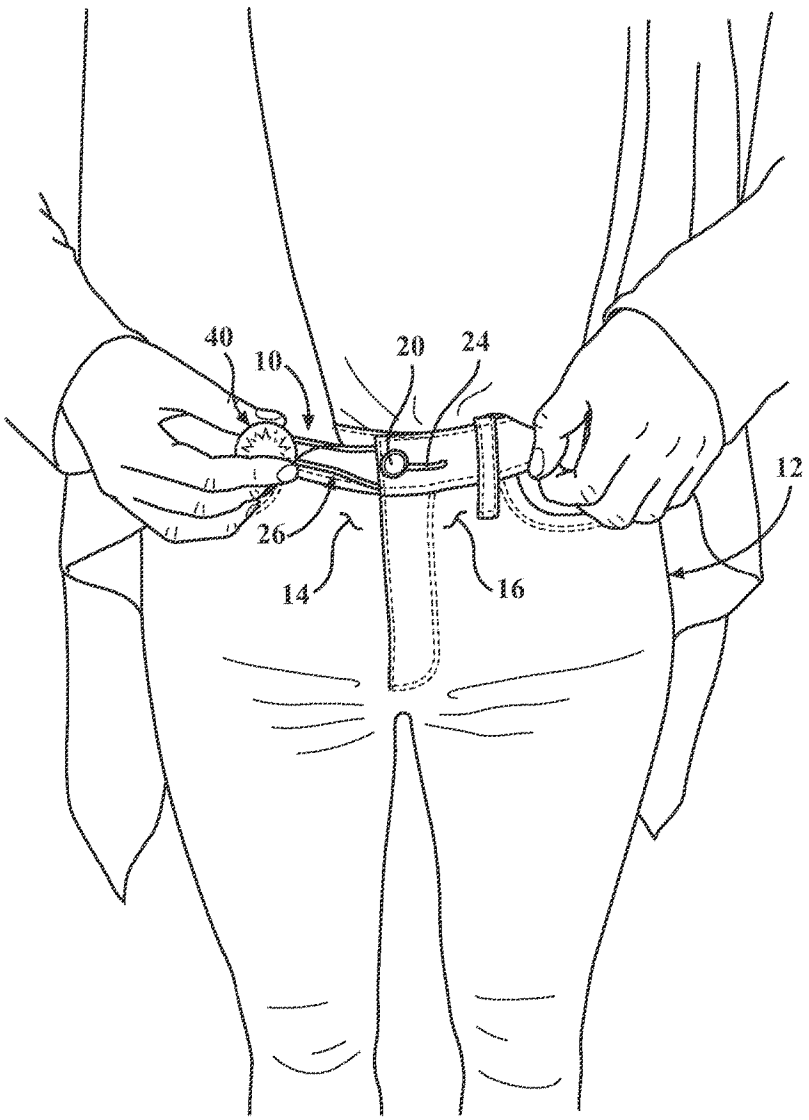
FIG. 1B is a view as in FIG. 1A showing a further progression of the installation process in which the over-flap of the trouser pants is secured by connection with the button thereby trapping the removeable decorative button cover assembly on the button in-between the under- and over-flaps of the trousers.
Figure 1A:
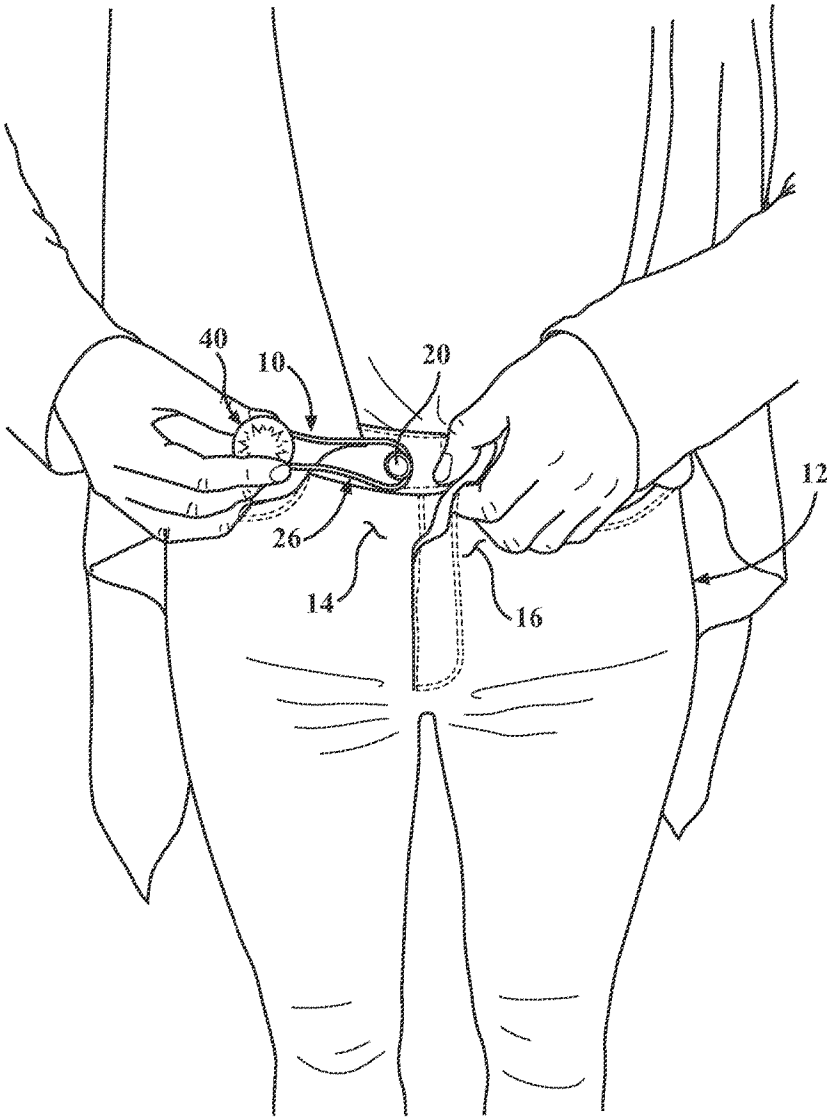
FIG. 1A is an environmental view showing a person wearing trouser pants of the type having a waist band with an over-flap temporarily unsecured to expose the head of a button on an under-flap, and a removeable decorative button cover assembly according to one embodiment of the invention disposed for installation.
Figure 1D:
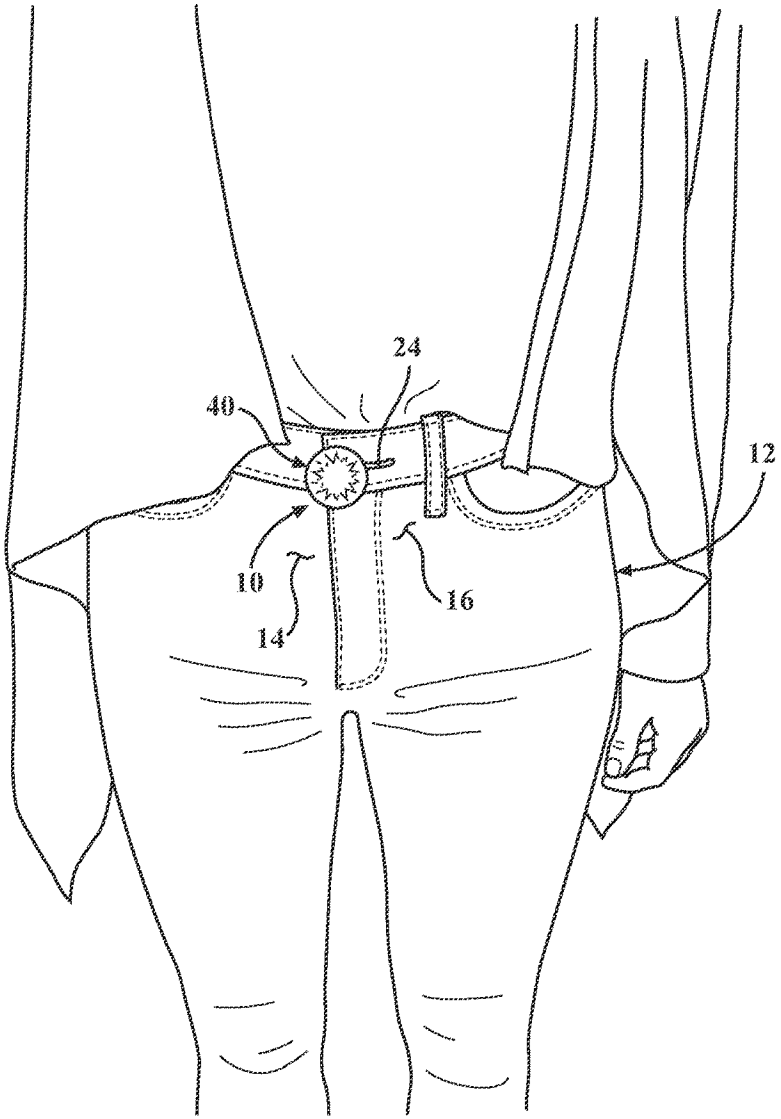
FIG. 1D is a view as in FIG. 1C showing the removeable decorative button cover assembly in the final installed position in which the button is fully occluded by a decorative cover of the removeable decorative button cover assembly.
Figure 1C:
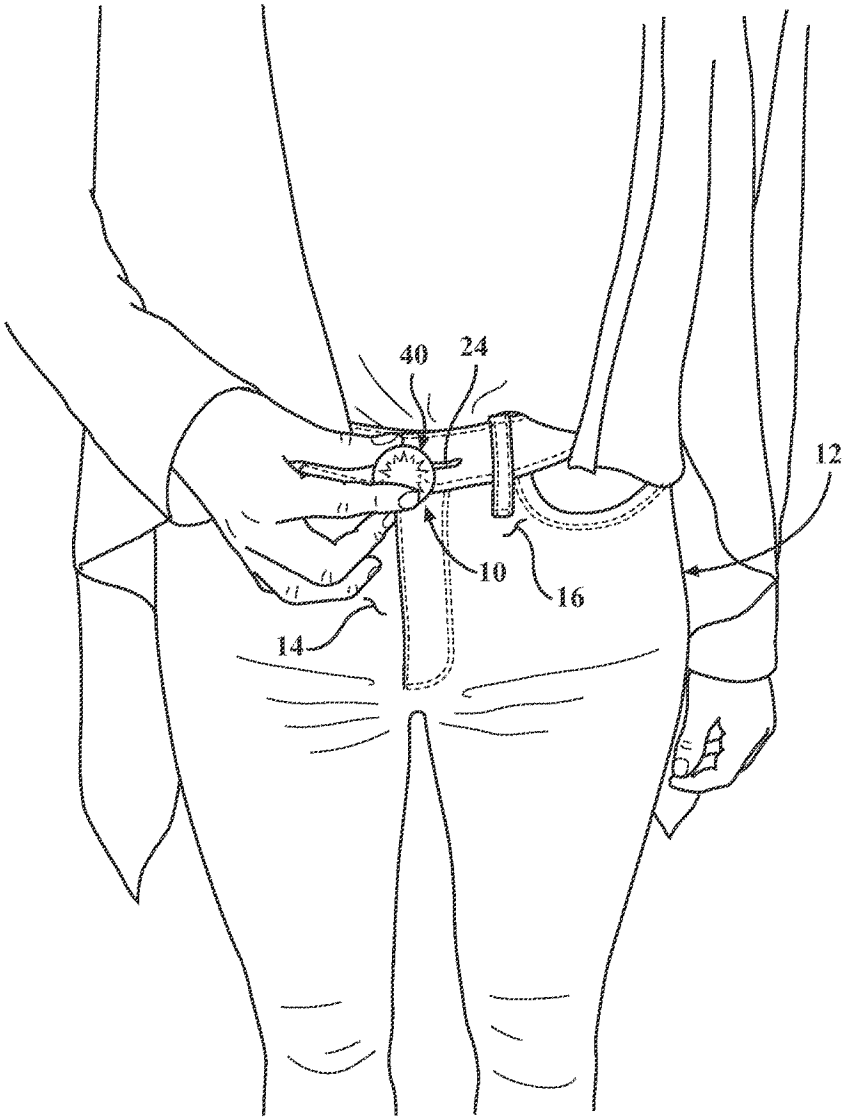
FIG. 1C is a view as in FIG. 1B showing a further progression of the installation process in which the removeable decorative button cover assembly is slid toward a final installed position while remaining trapped on the button.

The over-flap 16 includes a slot 24 formed therein, as best seen in FIGS. 1B & 1D. The slot has a length greater than the head diameter of the button 18. Thus, the flap is configured to be secured in a closed condition by inserting the head 20 of the button 18 through the slot 24 on the over-flap 16, according to the well-known practice.

Figure 2:
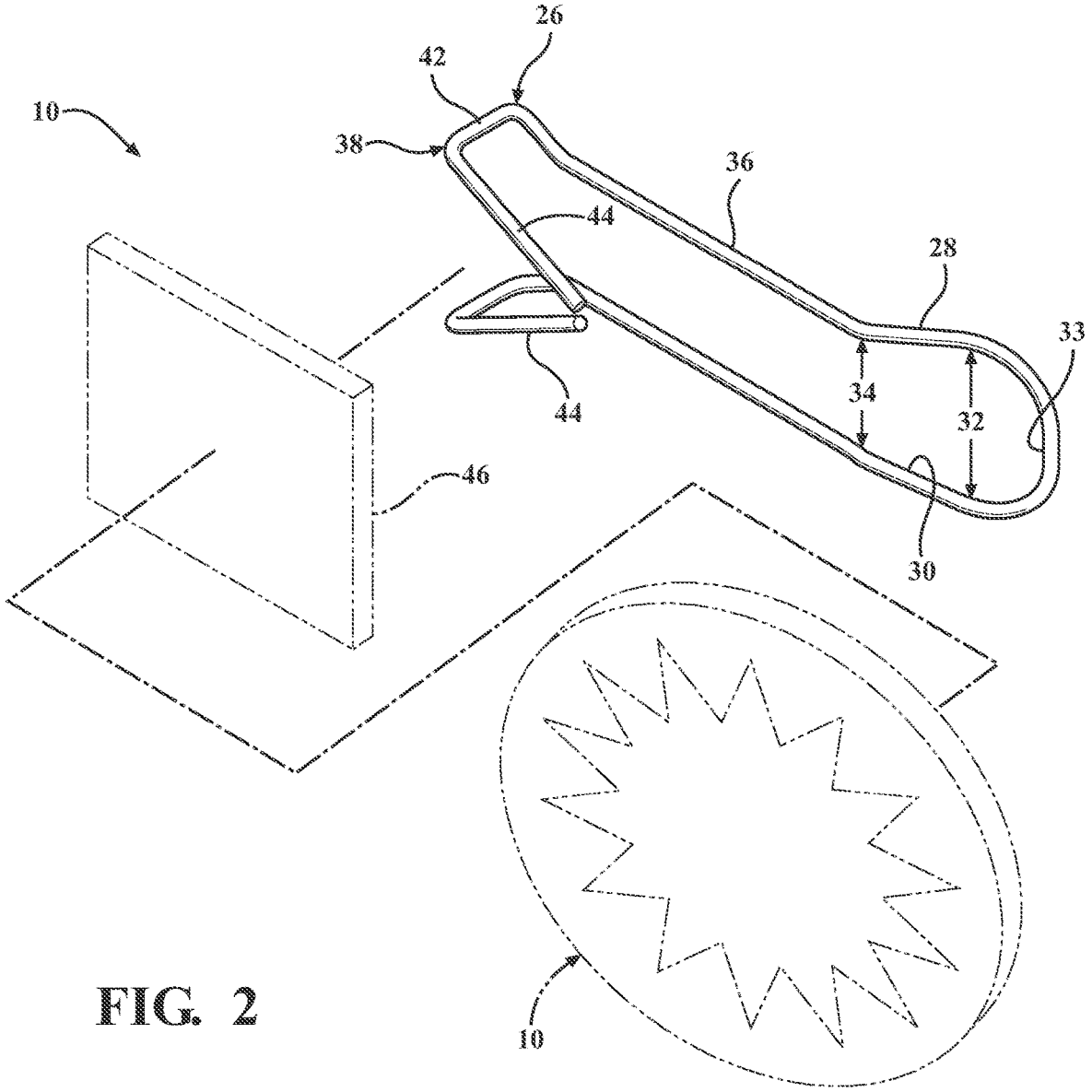
FIG. 2 is a perspective view of the clip portion of a button-supported fashion accessory according to one embodiment of the invention, with mounting and decorative cover portions exploded and in phantom.
Figure 3:
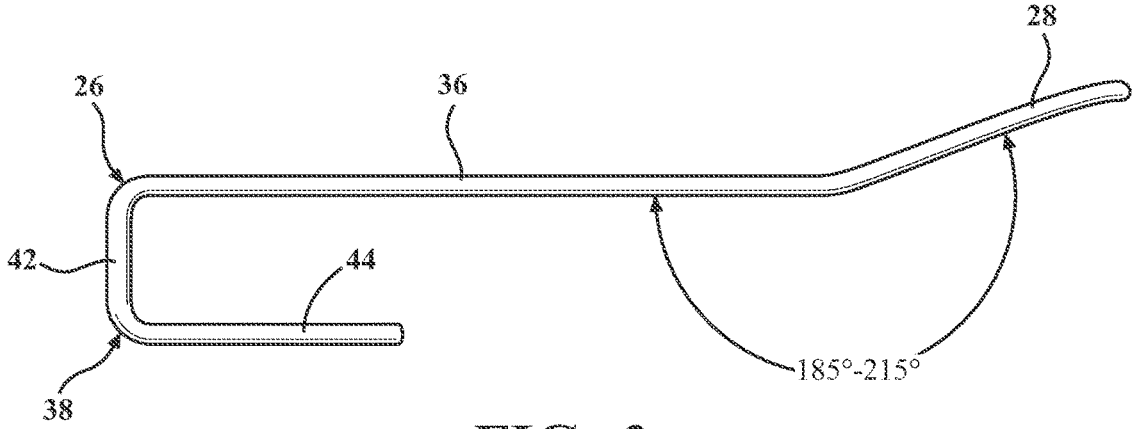
FIG. 3 is a side view of the clip portion of the button-supported fashion accessory of FIG. 2.

The removeable decorative button cover assembly 10 includes a clip portion, generally indicated at 26. The clip 26 may be fabricated from any suitable material, including but not limited to bent wire, sheet metal, wood, plastic and combinations thereof. In the illustrated examples, the clip 26 is made at least in part from bent wire. The clip 26 is best seen in FIGS. 2-4.

At one end of the clip 26 is formed a snare 28. When viewed from the top, as in FIG. 3, the snare 28 can be seen to reside within a common plane. I.e., the snare 28 may be a generally planar formation. However, in other contemplated embodiments the snare 28 may be curved in this top view or may take other shapes deemed desirable. Turning to the front view of FIG. 4, the snare 28 is portrayed as having an aperture 30. That is, the snare 28 represents the end or terminal portion of the clip 26, and the aperture 30 is the open inside region of the snare 28. This open inside region, or aperture 30, is defined by an enlarged ingress/egress region 32 and a constricted neck section 34. The ingress/egress region 32 and neck section 34 are identified in FIG. 4 by their relative spans or measures across the aperture 30. In the illustrated embodiment, the aperture 30 tapers uniformly between the ingress/egress region 32 and the neck section 34. The snare 28 can take many different forms. In the illustrated examples, the snare 28 comprises a monolithic wire element bent into the general shape of a horseshoe.

The ingress/egress region 32 is bounded on one side thereof (the right side in FIG. 4) by an interior stopper edge 33. The interior stopper edge 33 of the aperture 30 is disposed adjacent the ingress/egress region 32 and remote from the neck section 34, as shown in FIG. 4. This interior stopper edge 33 may be a semi-circular formation as defined by the aforementioned major dimension or span of the ingress/egress region 32. In other contemplated embodiments, the interior stopper edge 33 could have a shape other than semi-circular. For example, the interior stopper edge 33 could be straight across thus forming a squarish shaped end of the aperture 30, or could be V-shaped or ogee-shaped, etc. The fact that the interior stopper edge 33 of the aperture 30 is bounded, i.e., closed, is more important than its specific geometric shape. The major dimension of the ingress/egress region 32 is greater than the diameter of the button head 20 to enable the head 20 to pass freely through the aperture 30.

Figure 4:
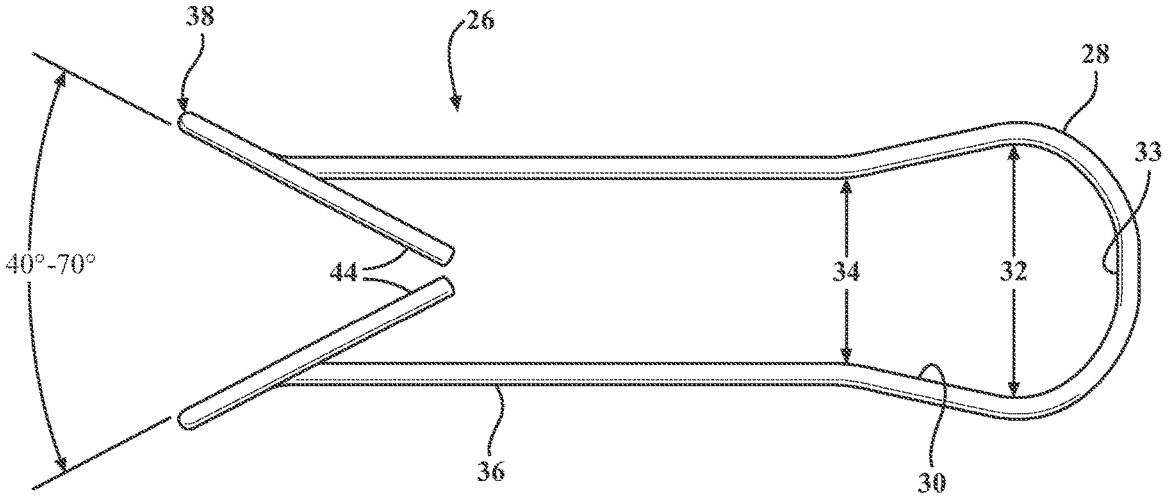
FIG. 4 is a top view of the clip portion of the button-supported fashion accessory of FIG. 3.

The neck section 34, which as stated previously is defined by the minor dimension shown in FIG. 4, which can be clearly seen as smaller than the major dimension of the ingress/egress region 32. The minor dimension of the neck section 34 is smaller than the diameter of the button head 20, yet greater than the diameter of the button shaft 22. This is to enable the head 20 of the button 18 to be trapped behind the neck section 34 of the aperture 30, although the shaft 22 of the button 18 can pass freely through the neck section 34.

The clip 26 also has an elongated slider bar 36 that extends directly from the snare 28. The slider bar 36 can take many different forms. In the illustrated examples, the slider bar 36 comprises a pair of wire elements that extend monolithically from the wire elements forming the snare 28. The end of the slider bar 36 that adjoins the snare 28 may be designated as a service end. The opposite end of the slider bar 36 is designated as a display end. Thus, the slider bar 36 extends between two opposite ends, namely a service end (adjacent the snare 28) and a display end. As viewed in the top views of FIGS. 3 and 5, the slider bar 36 may be contained within a unitary plane. However, in other contemplated embodiments the slider bar 36 may be curved in this top view or may take other shapes deemed desirable. Continuing in the perspective of a top view as in FIGS. 3 and 5, the slider bar 36 and snare 28 could appear as a continuous curving structure, such as may be configured to match the anticipated curvature of a human user's body. However, in the illustrated examples the snare 28 lies within a plane that is obliquely angled with respect to the plane of the slider bar 36. The oblique angle A of the snare 28 is shown residing in a range between approximately 185-215° measured relative to the slider bar 36. This range is rather ideally suited for trouser applications so as to conform to the average human waist curvature. In some applications, the oblique angle A of the snare 28 may be more specifically established as approximately 200° measured relative to the slider bar 36.

The slider bar 36 establishes a constrained path between its service and display ends configured to guide a captive button 18 traveling back-and-forth therealong. The constrained path may be curved, but in the illustrated examples is generally linear. This linear path is defined by opposing and generally parallel interior boundary edges. These interior boundary edges extend from the neck section 34 of the snare 28 toward the display end of the slider bar 36. As perhaps best shown in FIG. 4, the lateral spacing between the interior boundary edges is thus generally equal to the minor dimension (neck section 34) of the aperture 30 in the snare 28. The constrained path has a longitudinal length at least twice as long as the lateral spacing between the boundary edges. That is to say, the longitudinal distance between service and display ends of the slider bar 36 is greater than or equal to the minor dimension (neck section 34) of the aperture 30. This length benefits the installation process as described below and shown in FIGS. 1A and 6A. In the front view of FIG. 4, the bounded interior region formed between the aperture 30 and slide bar 36 take the shape of a keyhole. The button 18 is confined within, but freely moveable about, this keyhole space.

In the example of FIGS. 2 and 4, it can be seen that the boundary edges of the slider bar 36 adjacent the display end can be formed so as to diverge, or spread apart, from one another. And notably, at the display end of the slider bar 36, the constrained path is open, i.e., un-blocked. It would be accurate to say that both the service end and the display end of the slider bar 36 are unbarricaded, although as will be described subsequently a button 18 held captive in the slider bar 36 cannot travel exit the slider bar 36 through the display end.

The clip 26 also includes a bracket, generally indicated at 38, that extends from the display end of the slider bar 36. The function of the bracket 38 is to connect the clip 26 to a decorative cover, generally indicated at 40. The bracket 38 has a standoff portion 42 and a mounting portion. The standoff portion 42 directly connects to the slider bar 36 and is oriented generally perpendicularly relative to the plane of the slider bar 36. Returning to the top views of FIGS. 3 and 5, it can be seen that the standoff portion 42 extends in a direction opposite from that of the snare 28. That is to say, relative to the plane of the slide bar 36, the snare 28 angles rearwardly into the body of the user whereas the projects forwardly away from the user's body. As perhaps best shown in FIG. 6C, the function of the standoff portion 42 is to distance the mounting portion from the head 20 of the button 18 when in its final installed position. To accomplish this objective, the standoff portion 42 is at least as long as the combined thicknesses of the over-flap 16 and button head 20. That is to say, the standoff portion 42 must establish clearance space for the mounting portion above the button head 20 and over-flap 16 as viewed in FIG. 6C. The standoff portion 42 can take many different forms. In the illustrated examples, the standoff portion 42 comprises a pair of wire elements that extend monolithically from the wire elements forming the slider bar 36.

Figure 5:
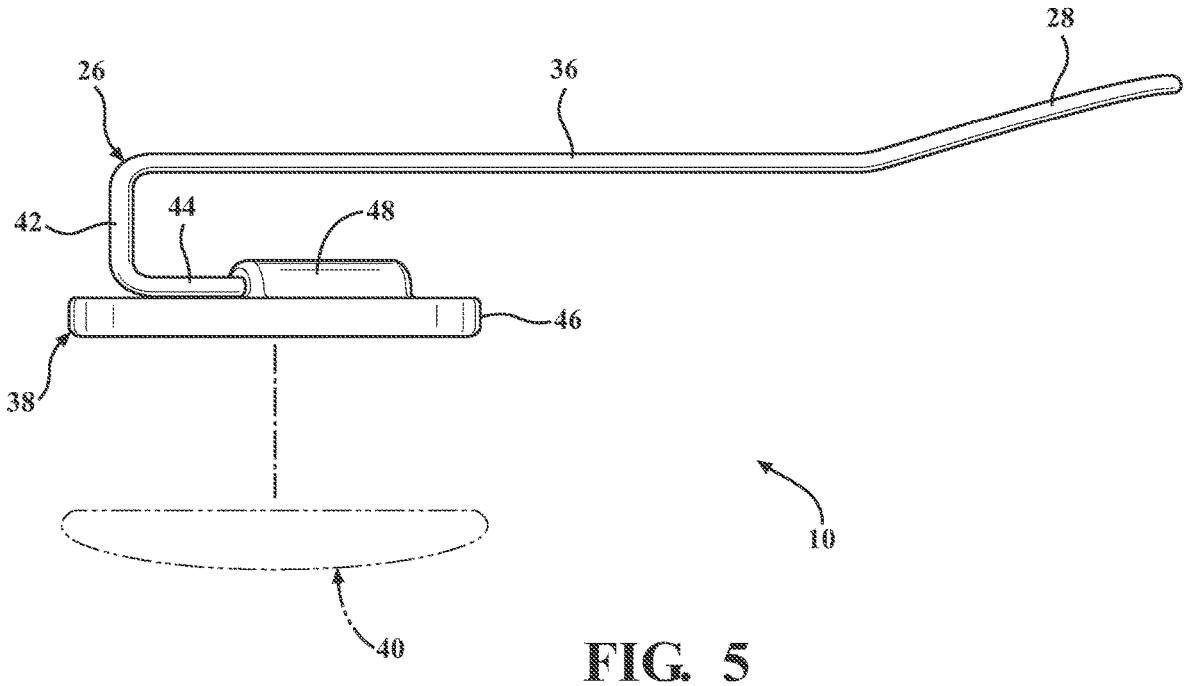
FIG. 5 is a side view as in FIG. 3 but showing a mounting portion connected to the clip and a decorative cover exploded and in phantom.

The mounting portion is connected to the standoff portion 42 so as to be spaced from the slider bar 36 generally over the display end. In most embodiments, it is expected that the mounting portion will be oriented generally parallel to the plane of the slider bar 36 as shown in FIGS. 5-6C. The mounting portion can take many different forms. In the illustrated examples, the mounting portion is a composite structure formed, in part, by a pair of prongs 44 that extend monolithically from the wire elements forming the standoff portion 42. In the illustrated examples, the mounting portion also includes a receiving pad 46 which may be formed of plastic or wood or any other suitable material. At least one, but preferably two, fixation sockets 48 are formed on the backside of the receiving pad 46. The fixation sockets 48 are configured to directly attach to the respective prongs 44 as shown in FIG. 5. The prongs 44 are shown converging toward one another in FIG. 4, which would require the fixation sockets 48 to have a corresponding splay. The included angle between the prongs 44 is preferably in the range of about 40-70°. In the illustrated example of FIG. 4, the included angle is shown about 55° which has been found to provide good results. The angled nature of the prongs 44 relative to the elongated slide bar 36 will provide a mechanical interlock to resist disconnection between prongs 44 and receiving pad 46 in use.

The decorative cover 40 may be any suitable piece of jewelry or emblem. In some examples, the decorative cover 40 could be a polished stone, a small work of art, an insignia, a photo frame, a slim box, an illuminating device, a camera or any other object of suitable size and weight and quality. The decorative cover 40 is supported directly from the mounting portion of the clip 26. And more specifically, the decorative cover 40 may be attached directly to the receiving pad 46, such as by adhesive, hook-and-loop, magnetic attraction, mechanical fasteners or any other suitable technique. Thus, the receiving pad 46 is preferably designed to provide an optimal attachment surface for the decorative cover 40.

Figure 8:
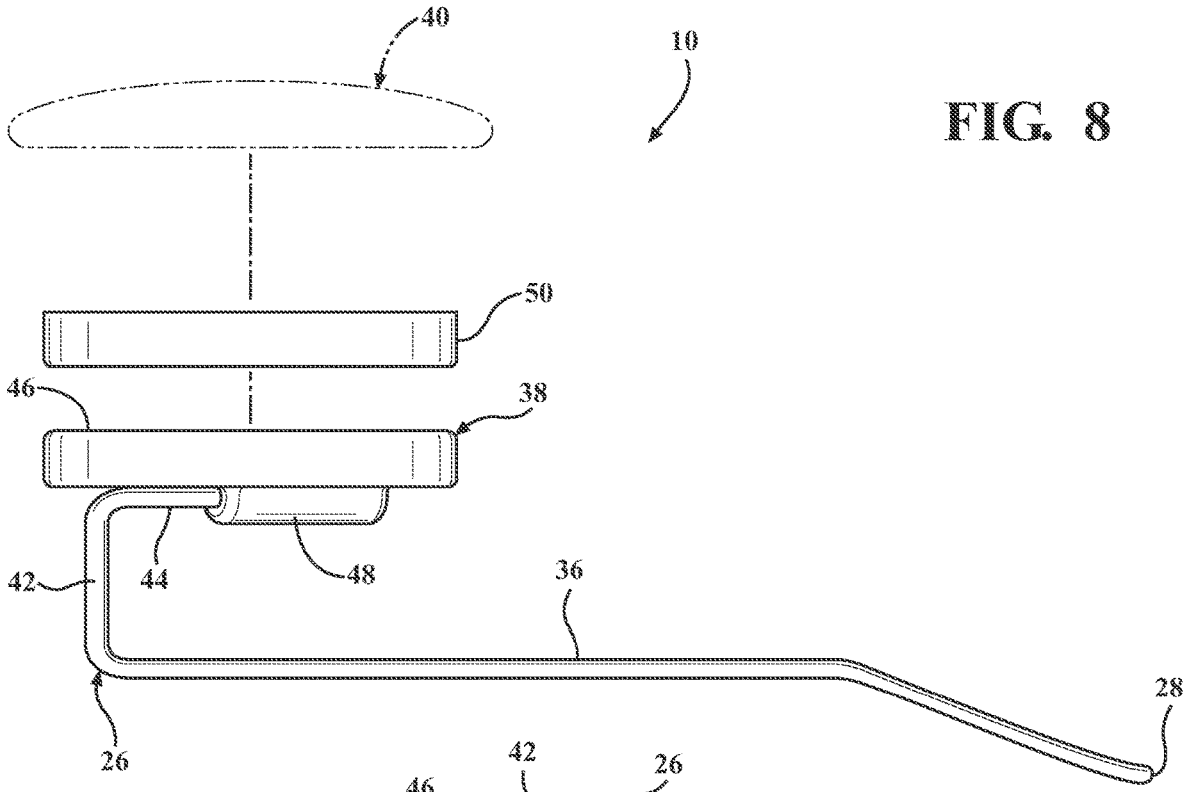
FIG. 8 depicts the removeable decorative button cover assembly in exploded view format according to an alternative embodiment of the invention in which a ferro-magnetic interface enables quick-change functionality to the decorative cover.
Figure 9:
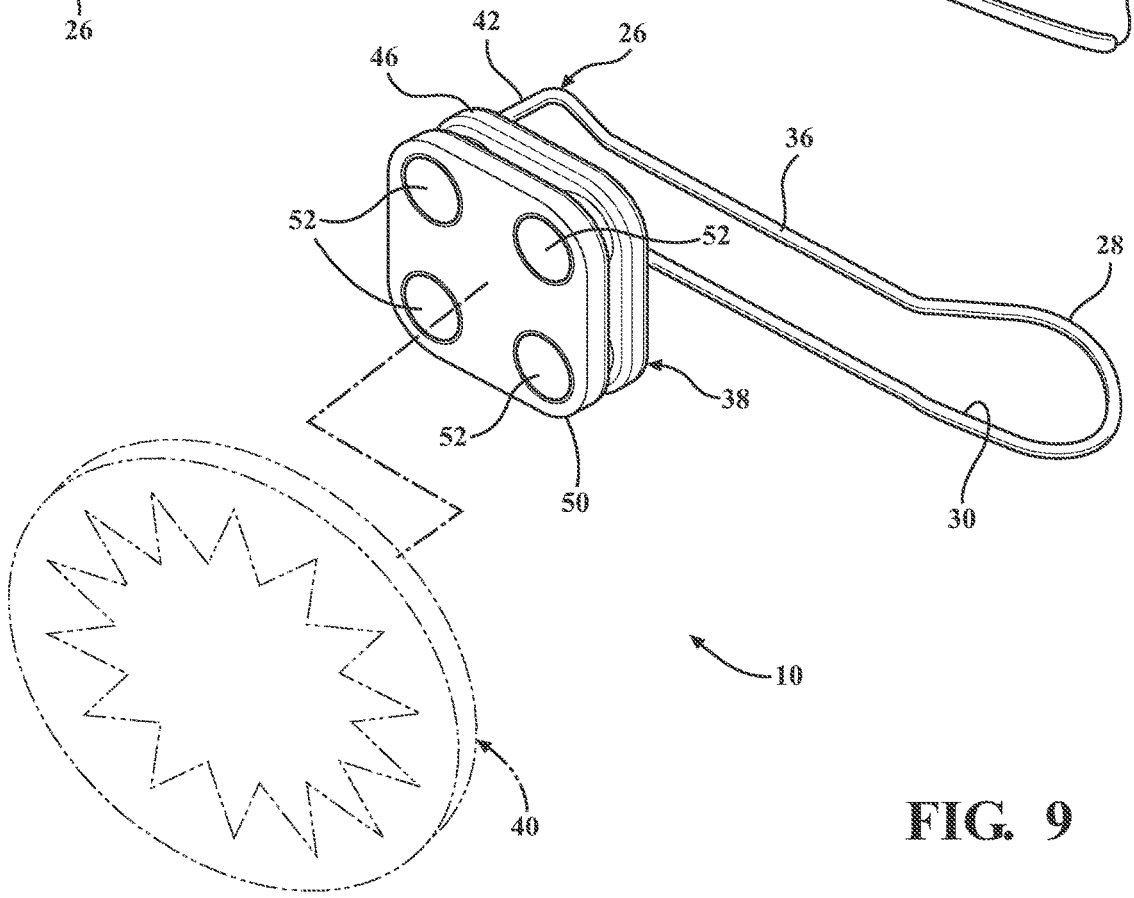
FIG. 9 is a perspective view of the alternative embodiment of FIG. 8.

FIGS. 8 and 9 describe an alternative embodiment of the invention, in which the mounting portion is specially adapted to enable quick-change ability for interchanging among several decorative covers 40. For example, a user may own only one clip 26, but numerous decorative covers 40 that can be interchanged on-the-fly. To accomplish this objective, the decorative cover 40 is mated with an interface 50. It is envisioned that each decorative cover 40 in a user's collection will be mated with a dedicated interface 50. The interface 50 is fitted with one part of a two-part fastening system, whereas the receiving pad 46 is fitted with the second part of the two-part fastening system. For example, the fastening system is hook-and-loop, the interface 50 may carry the hook part and the receiving pad 46 the loop part. Or, if the fastening system comprises male and female self-locking elements, the interface 50 may carry the male part(s) and the receiving pad 46 the female part(s). The examples depicted in FIGS. 8 and 9 show yet another contemplated embodiment, wherein the fastening system relies on magnetic attraction. In this example, the interface 50 may carry the magnetized elements 52 and the receiving pad 46 ferrous receptors. Of course, the interface 50 may be integrated directly into the decorative cover 40, such as by gluing a magnet 52 directly to is back. In that case, the glue or other design feature integral with the decorative cover 40 could be considered the interface 50. Numerous variations will become apparent to those of skill in the art when it is contemplated that the mounting portion and interface 50 are configured with mutually attractive ferro-magnetic properties.

Turning now to FIGS. 1A-D and 6A-C, use of the present invention will be described in the context of a button cover for trousers 12. To install the assembly 10, a user must first unfasten the flap at the waistband by desecuring the over-flap 16 from the under-flap 14 thus fully exposing the button 18. This is shown in FIGS. 1A and 6A. With the button 18 fully exposed, the user will attach the snare 28 by passing its aperture 30 over the button head 20 in the vicinity of the ingress/egress region 32.

Next, the over-flap 16 of the trousers 12 are re-secured in the normal fashion by passing the slot 24 over the button head 20. See FIG. 1B. The thin construction of the snare 26 takes advantage of the inherent clearance at the button 18 connection so that the flap can be readily made fast without undue stress on the button joint. At this point, the clip 26 becomes trapped or confined on the shaft 22 of the button 18 in-between the under- and over-flaps 14, 16. It is impossible to remove the clip 26 without unfastening the flap and exposing the button 18, which means it is now impossible for the assembly 10 to be accidentally lost.

Figure 6B:
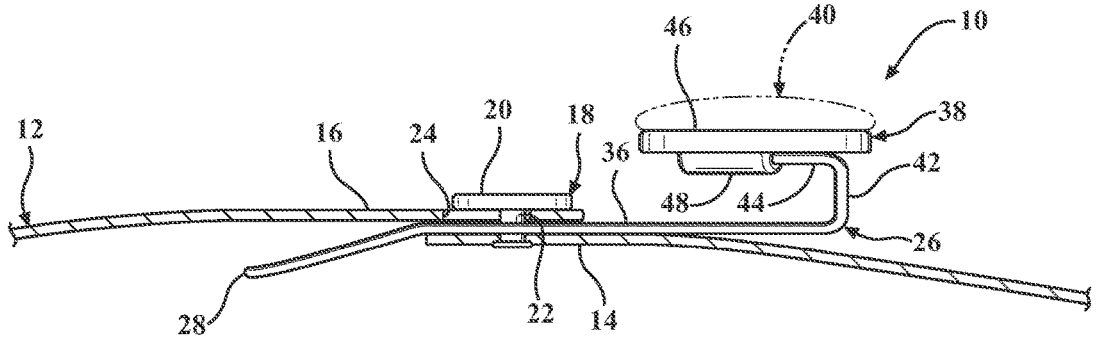
FIG. 6B is a view as in FIG. 6A showing a further progression of the installation process in which the over-flap of the trouser pants has been secured by connection with the button and the removeable decorative button cover assembly is in transit toward a final installed position.
Figure 6C:
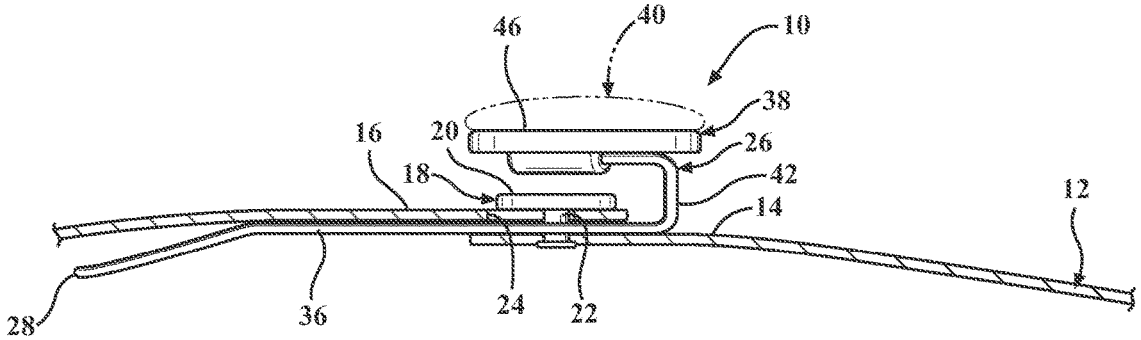
FIG. 6C is a view as in FIG. 6B, corresponding generally to FIGS. 1C and 1D, showing the removeable decorative button cover assembly in the final installed position.
Figure 7:
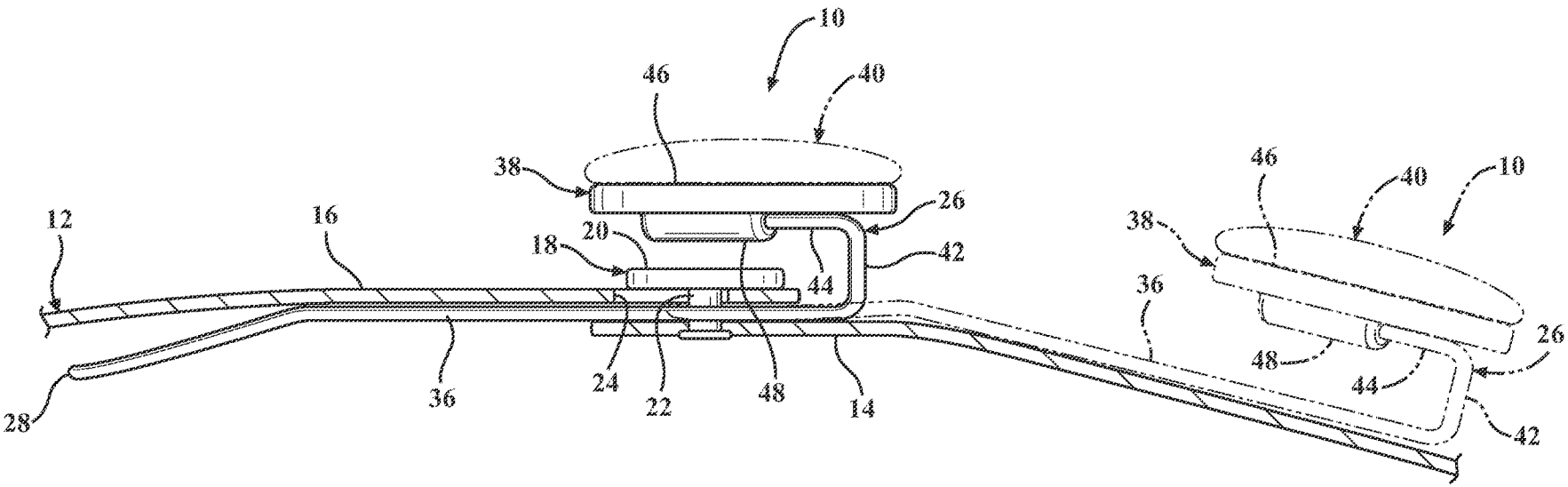
FIG. 7 is an enlarged view as in FIG. 6C but showing in phantom the removeable decorative button cover assembly shifted away from its final installed position such as by accidental impact.

Next, the user will begin to slide the snare 28 into the trousers 12, causing the shaft 22 of the button 18 to pass through the neck section 34 and into the elongated slide bar 36, as shown in FIG. 6B. Under continued urging, the assembly 10 will slide until the standoff portion 42 makes contact with the edge of the over-flap 16. As can be clearly seen in FIG. 6C, the leading edge of the over-flap 16 becomes sheltered between the slider bar 36 and the receiving pad 46. At this point, corresponding to FIGS. 1C, 1D and 6C, the decorative cover 40 is hovering directly in front of the head 20 of the button 18, like a canopy, occluding or eclipsing the head 20 from view except from the eye of the user themselves. Rather, the decorative cover 40 will appear, to third-party observers, to occupy the space where a button head 20 would normally be, thus creating an aesthetically pleasing and fashionable appearance.

It is therefore a distinct advantage of this invention that the slider bar 36 can be inextricably trapped between the under-flap 14 and over-flap 16 sections, on the shaft 22 of the button 18, when the button head 20 is secured through the slot 24 in the over-flap 16. I.e., when the flap is secured closed, the clip 26 cannot be removed from the trousers 12—it is trapped inextricably. And yet in this inextricably trapped condition, the decorative cover 40 is freely moveable toward and away from a position directly overlying the button head 20.

To remove the assembly 40 from the trousers, the described steps are followed in reverse order.

The assembly 10 is unique, easy to use, inexpensive to manufacture, light weight, and offers several distinct and high beneficially advantages. One such advantage is that, in use, the slider bar 36 is trapped between the under-flap 14 and over-flap 16 on the shaft 22 of the button 18. Travel of the captive button 18 is arrested at one end by the bounded interior stopper edge 33 of the snare 28, and at the other end by the standoff portion 42 colliding with the over-flap 16. Thus, once installed, if the user accidentally snags the decorative cover 40 on an object the entire assembly 10 cannot be disconnected from the trousers 12. Another advantage is that the oblique angle A of the snare 28 facilitates installation by naturally angling aperture 30 so that the button 18 can be easily hooked. This permits the assembly 10 to be discretely installed (FIG. 1A) with only minimal expose of the over-flap 16. Furthermore, the oblique angle A of the snare 28 creates a natural bend in the hidden parts of the clip 26 that will better conform to the curved body of the user. This will enable a more comfortable fit less likely to poke or press against the wearer during extended periods of use. And a still further advantage of the snare 28 is that it is prone to retain the assembly on the button 18 even after the flap has been undone. There may be instances where the user wishes to temporarily undress, such as when re-tucking a shirt or perhaps using the lavatory. Or, there could be occasions when the flap is susceptible to come undone of its own accord without warning, such as due to poor fit or poor design. When the flap becomes unsecured for whatever reason, the snare 18 with its interior stopper edge 33 will naturally cling to the button 18, thus reducing the likelihood of the assembly 10 falling to the floor.

Those of skill in the art will readily appreciate adaption of these methods of use to applications other than trousers 12.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A combination article of clothing and removeable decorative button cover assembly therefor, said combination comprising:

an article of clothing having a flap section, said flap section comprising an under-flap portion and an opposing over-flap portion, a button secured to said under-flap section, said button having an enlarged head attached to and extending from a shaft, said shaft having a shaft diameter, said head of said button having a head diameter greater than said shaft diameter, said over-flap portion having a leading edge, said over-flap including a slot formed therein and backset from said leading edge, said slot having a length greater than said head diameter of said button, said flap section secured in a closed condition by said button operatively disposed in said slot on said over-flap, an elongated slider bar having a service end and a display end, said slider bar having opposing interior boundary edges establishing a constrained path between said service and display ends configured to guide said button captive back-and-forth therealong, a bracket extending from said display end of said slider bar, said bracket having a standoff portion and a mounting portion, said standoff portion directly connected to said slider bar, said mounting portion connected to said standoff portion and spaced from said slider bar generally over said display end, a decorative cover supported from said mounting portion of said bracket and also spaced from said slider bar generally over said display end, a snare attached to said service end of said slider bar, said snare having an aperture configured to receive and then trap said head of said button on one side of said slider bar, said aperture being bounded by an interior stopper edge on an end thereof opposite said slider bar, said interior stopper edge extending between and interconnecting said opposing interior boundary edges to form a barrier to said button, said slider bar and said snare being trapped between said under-flap and over-flap portions on said shaft of said button with said button head secured through said slot on said over-flap portion, said decorative cover being moveable relative to said button between two positions of extreme limits of travel wherein in one extreme position said interior stopper edge of said snare abuts said shaft of said button and in the other extreme position said standoff portion abuts said leading edge of said over-flap portion.

2. The assembly of claim 1, wherein said aperture is defined by an enlarged ingress/egress region and a constricted neck section, said interior stopper edge of said aperture disposed adjacent ingress/egress region and remote from said neck section, said ingress/egress region defined by a major dimension, said major dimension being greater than said head diameter to enable said head of said button to pass freely through said aperture, said neck section defined by a minor dimension smaller than said major dimension, said minor dimension being greater than said shaft diameter of said button.

3. The assembly of claim 1, wherein said article of clothing comprises trouser pants, said trouser pants having a waist band made discontinuous by said flap section.

4. The assembly of claim 1, wherein said slider bar and said snare and at least a portion of said bracket are fabricated from a monolithic piece of bent wire, said mounting portion including a pair of prongs, said prongs converging toward one another.

5. The assembly of claim 1, wherein said aperture is defined by an enlarged ingress/egress region and a constricted neck section, said interior stopper edge of said aperture disposed adjacent ingress/egress region and remote from said neck section, said aperture being configured as a generally uniform taper between said ingress/egress region and said neck section.

6. The assembly of claim 1, wherein said aperture is defined by an enlarged ingress/egress region and a constricted neck section, said interior stopper edge of said aperture disposed adjacent ingress/egress region and remote from said neck section, said interior stopper edge comprising a generally semi-circular portion of said ingress/egress region.

7. The assembly of claim 1, wherein said aperture is defined by an enlarged ingress/egress region and a constricted neck section, said interior stopper edge of said aperture disposed adjacent ingress/egress region and remote from said neck section, said constrained path of said slider bar is generally linear and defined by opposing and generally parallel boundary edges, said boundary edges extending from said neck section of said snare to said display end.

8. The assembly of claim 7, wherein the lateral spacing between said boundary edges is generally equal to said minor dimension of said aperture in said snare section, and said constrained path of said slider bar having a longitudinal length at least twice as long as the lateral spacing between said boundary edges.

9. The assembly of claim 1, wherein said constrained path is generally linear and defined by opposing and generally parallel boundary edges.

10. The assembly of claim 9, wherein said boundary edges extend from said neck section of said snare to said display end.

11. The assembly of claim 10, wherein the lateral spacing between said boundary edges is generally equal to said minor dimension of said aperture in said snare section.

12. The assembly of claim 11, wherein said constrained path has a longitudinal length at least twice as long as the lateral spacing between said boundary edges.

13. The assembly of claim 12, wherein said boundary edges of said slider bar diverge from one another adjacent said display end.

14. The assembly of claim 1, wherein said snare angles obliquely from said slider bar away from said decorative cover.

15. A combination article of clothing and removeable decorative button cover assembly therefor, said combination comprising:

an article of clothing having a flap section, said flap section comprising an under-flap portion and an opposing over-flap portion, a button secured to said under-flap section, said button having an enlarged head attached to and extending from a shaft, said shaft having a shaft diameter, said head of said button having a head diameter greater than said shaft diameter, said over-flap portion having a leading edge, said over-flap including a slot formed therein and backset from said leading edge, said slot having a length greater than said head diameter of said button, said flap section secured in a closed condition by said button, an elongated slider bar having a service end and a display end, said slider bar having opposing interior boundary edges establishing a constrained path between said service and display ends configured to guide said button captive back-and-forth therealong, said constrained path being generally linear and defined by opposing and generally parallel boundary edges, a bracket extending from said display end of said slider bar, said bracket having a standoff portion and a mounting portion, said standoff portion directly connected to said slider bar, said mounting portion connected to said standoff portion and spaced from said slider bar generally over said display end, a decorative cover supported from said mounting portion of said bracket and spaced from said slider bar generally over said display end, a snare attached to said service end of said slider bar, said snare having an aperture configured to receive and then trap said head of said button on one side of said slider bar, said aperture being bounded by an interior stopper edge on an end thereof opposite said slider bar, said interior stopper edge extending between and interconnecting said opposing interior boundary edges, said slider bar and said snare disposed between said under-flap and over-flap portions while held captive on said shaft of said button, said decorative cover being moveable relative to said button between two positions of extreme limits of travel wherein in one extreme position said interior stopper edge of said snare abuts said shaft of said button and in the other extreme position said standoff portion abuts said leading edge of said over-flap portion.

16. The assembly of claim 15, wherein said constrained path is generally linear and defined by opposing and generally parallel boundary edges, said boundary edges extending from said neck section of said snare to said display end, the lateral spacing between said boundary edges being generally equal to said minor dimension of said aperture in said snare section.

17. The assembly of claim 16, wherein said constrained path has a longitudinal length at least twice as long as the lateral spacing between said boundary edges.

18. The assembly of claim 15, wherein said snare angles obliquely from said slider bar away from said decorative cover.

19. The assembly of claim 15, wherein said aperture is defined by an enlarged ingress/egress region and a constricted neck section, said interior stopper edge of said aperture disposed adjacent ingress/egress region and remote from said neck section, said ingress/egress region defined by a major dimension, said major dimension being greater than said head diameter to enable said head of said button to pass freely through said aperture, said neck section defined by a minor dimension smaller than said major dimension, said minor dimension being greater than said shaft diameter of said button.

20. A combination article of clothing and removeable decorative button cover assembly therefor, said combination comprising:

an article of clothing, said article of clothing comprising trouser pants, said article of clothing having a flap section, said trouser pants having a waist band made discontinuous by said flap section, said flap section comprising an under-flap portion and an opposing over-flap portion, a button secured to said under-flap section, said button having an enlarged head attached to and extending from a rigid shaft, said shaft being generally cylindrical and having a shaft diameter, said head of said button being generally circular and having a head diameter greater than said shaft diameter, said over-flap portion having a leading edge, said over-flap including a slot formed therein backset from said leading edge, said slot having a length greater than said head diameter of said button, said flap section being configured to be secured in a closed condition by inserting said head of said button through said slot on said over-flap, a clip, said clip fabricated at least in part from bent wire, said clip having a snare at one end thereof, said snare having an aperture defined by an enlarged ingress/egress region and a constricted neck section, said aperture being configured as a generally uniform taper between said ingress/egress region and said neck section, said ingress/egress region bounded on one side thereof by a generally semi-circular interior stopper edge defined by a major dimension, said major dimension being greater than said head diameter to enable said head of said button to pass freely through said aperture, said neck section defined by a minor dimension smaller than said major dimension, said minor dimension being greater than said shaft diameter of said button, said aperture configured to trap said head of said button on one side thereof, said clip having an elongated slider bar extending directly from said snare, said slider bar having a service end and a display end, said slider bar establishing a constrained path between said service and display ends configured to guide said button captive back-and-forth therealong, said constrained path being generally linear and defined by opposing and generally parallel boundary edges, said boundary edges extending from said neck section of said snare to said display end, the lateral spacing between said boundary edges being generally equal to said minor dimension of said aperture in said snare section, said constrained path having a longitudinal length at least twice as long as the lateral spacing between said boundary edges, said boundary edges of said slider bar diverging from one another adjacent said display end, said snare being obliquely angled with respect to said slider bar, said oblique angle of said snare being between approximately 185-215° measured relative to said slider bar, said clip including a bracket extending from said display end of said slider bar, said bracket having a standoff portion and a mounting portion, said standoff portion directly connected to said slider bar, said standoff portion being oriented generally perpendicularly relative to said slider bar, said standoff portion extending in a direction opposite from said snare, said mounting portion connected to said standoff portion and spaced from said slider bar generally over said display end, said mounting portion attached to said standoff portion, said mounting portion being oriented generally parallel to said slider bar, said mounting portion comprising a pair of wire prongs, said wire prongs converging toward one another, said mounting portion including at least one fixation socket configured to directly attach to at least one of said wire prongs, said mounting portion including a receiving pad, a decorative cover supported from said mounting portion, said a decorative cover attached directly to said receiving pad, said decorative cover being moveable relative to said button between two positions of extreme limits of travel wherein in one extreme position said interior stopper edge of said snare abuts said shaft of said button and in the other extreme position said standoff portion abuts said leading edge of said over-flap portion.

* * * * *